US006679073B1

(12) United States Patent
Hu

(10) Patent No.: US 6,679,073 B1
(45) Date of Patent: Jan. 20, 2004

(54) REFRIGERATOR AND ICE MAKER METHODS AND APPARATUS

(75) Inventor: Ziqiang Hu, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/249,087

(22) Filed: Mar. 14, 2003

(51) Int. Cl.[7] ..... F25C 1/00

(52) U.S. Cl. ..... 62/135; 62/186; 62/340; 62/415

(58) Field of Search ..... 62/135, 186, 233, 62/340, 415, 416

(56) References Cited

U.S. PATENT DOCUMENTS

| | | | | |
|---|---|---|---|---|
| 3,192,726 A | | 7/1965 | Newton | |
| 3,200,600 A | | 8/1965 | Elfving | |
| 3,205,666 A | | 9/1965 | Gould et al. | |
| 3,332,807 A | | 7/1967 | Boehmer et al. | |
| 3,382,682 A | | 5/1968 | Frohbieter | |
| 3,771,319 A | | 11/1973 | Nichols et al. | |
| 4,055,053 A | | 10/1977 | Elfving et al. | |
| 4,197,717 A | * | 4/1980 | Schumacher | 62/213 |
| 4,424,683 A | | 1/1984 | Manson | |
| 4,475,357 A | | 10/1984 | Linstromberg | |
| 4,487,024 A | | 12/1984 | Fletcher et al. | |
| 4,587,810 A | | 5/1986 | Fletcher | |
| 4,644,753 A | | 2/1987 | Burke | |
| 4,727,720 A | | 3/1988 | Wernicki | |
| 4,843,833 A | | 7/1989 | Polkinghorne | |
| 5,477,699 A | | 12/1995 | Guess et al. | |
| 5,711,159 A | | 1/1998 | Whipple, III | |
| 5,729,997 A | * | 3/1998 | Witsoe | 62/407 |
| 5,778,677 A | | 7/1998 | Hung et al. | |
| 6,351,955 B1 | | 3/2002 | Oltman et al. | |
| 6,438,978 B1 | * | 8/2002 | Bessler | 62/179 |
| 6,438,988 B1 | * | 8/2002 | Paskey | 62/353 |
| 6,564,566 B2 | * | 5/2003 | Kim et al. | 62/225 |

OTHER PUBLICATIONS

U.S. patent application of Wiseman et al., for "Systems and Methods for Boosting Ice Rate Formation in a Refrigerator," Ser. No. 09/637,045, filed Aug. 11, 2000.

* cited by examiner

*Primary Examiner*—William E. Tapolcai
(74) *Attorney, Agent, or Firm*—H. Neil Houser, Esq.; Armstrong Teasdale LLP

(57) ABSTRACT

An ice maker includes a mold including at least one cavity for containing water therein for freezing into ice, a water supply including at least one valve for controlling water flow into the mold, an ice removal heating element operationally coupled to the mold, and an ice maker control system operationally coupled to the valve and the ice removal heating element and configured to control the valve, control the ice removal heating element, and provide a signal to a refrigerator control system.

12 Claims, 4 Drawing Sheets

REFRIGERATOR AND ICE MAKER METHODS AND APPARATUS

BACKGROUND OF INVENTION

This invention relates generally to refrigerators, and more specifically, to an ice maker for a refrigerator.

Some refrigerator freezers include an ice maker. The ice maker receives water for ice production from a water valve typically mounted to an exterior of a refrigerator case. A primary mode (if heat transfer for making ice is convection. Specifically, by blowing cold air over an ice maker mold body, heat is removed from water in the mold body. As a result, ice is formed in the mold. Typically, the cold air blown over the ice maker mold body is first blown over the evaporator and then over the mold body by the evaporator fan.

Heat transferred in a given fluid due to convection can be increased or decreased by changing a film coefficient. The film coefficient is dependent on fluid velocity and temperature. With a high velocity and low temperature, the film coefficient is high, which promotes heat transfer an d increasing the ice making rate. Therefore, when the refrigeration circuit is activated, i.e., when the compressor, evaporator fan, and condenser fan are on, ice is made at a quick rate as compared to when the refrigeration circuit is inactivated. Specifically, the air is not as cold and the air velocity is lower when the circuit is inactivated as compared to when the circuit is activated.

User demand for ice, however, is not related to the state of the refrigeration circuit. Specifically, a user may have a high demand for ice at a time in which the circuit in inactivated or may have no need for ice at a time at which the circuit is activated. Therefore, ice may be depleted during a period of high demand for ice by a user and the refrigeration circuit may not necessarily respond to the user demand by making ice more quickly.

SUMMARY OF INVENTION

In one aspect, an ice maker includes a mold including at least one cavity for containing water therein for freezing into ice, a water supply including at least one valve for controlling water flow into the mold, an ice removal heating element operationally coupled to the mold, and an ice maker control system operationally coupled to the valve and the ice removal heating element and configured to control the valve, control the ice removal heating element, and provide a signal to a refrigerator control system.

In another aspect, a refrigerator includes a fresh food compartment, a freezer compartment separated from the fresh food compartment by a mullion, an ice maker positioned within the freezer cavity, and a refrigerator control circuit configured to control a temperature of the freezer compartment and the fresh food compartment, the refrigerator control system is configured to receive a signal representative of a user selected ice maker speed.

In yet another aspect, a refrigerator includes a fresh food compartment, a refrigerator evaporator operationally coupled to the fresh food compartment and configured to cool the fresh food compartment, a refrigerator evaporator fan positioned to move air across the refrigerator evaporator, a freezer compartment separated from the fresh food compartment by a mullion, a freezer evaporator operationally coupled to the freezer cavity and configured to cool the freezer cavity, a freezer evaporator fan positioned to move air across the freezer evaporator, an ice maker positioned within the freezer cavity, and a refrigerator control system configured to control at least one of the freezer evaporator and the freezer evaporator fan, the refrigerator control system is configured to receive a signal regarding the ice maker.

DETAILED DESCRIPTION

Figure 1:
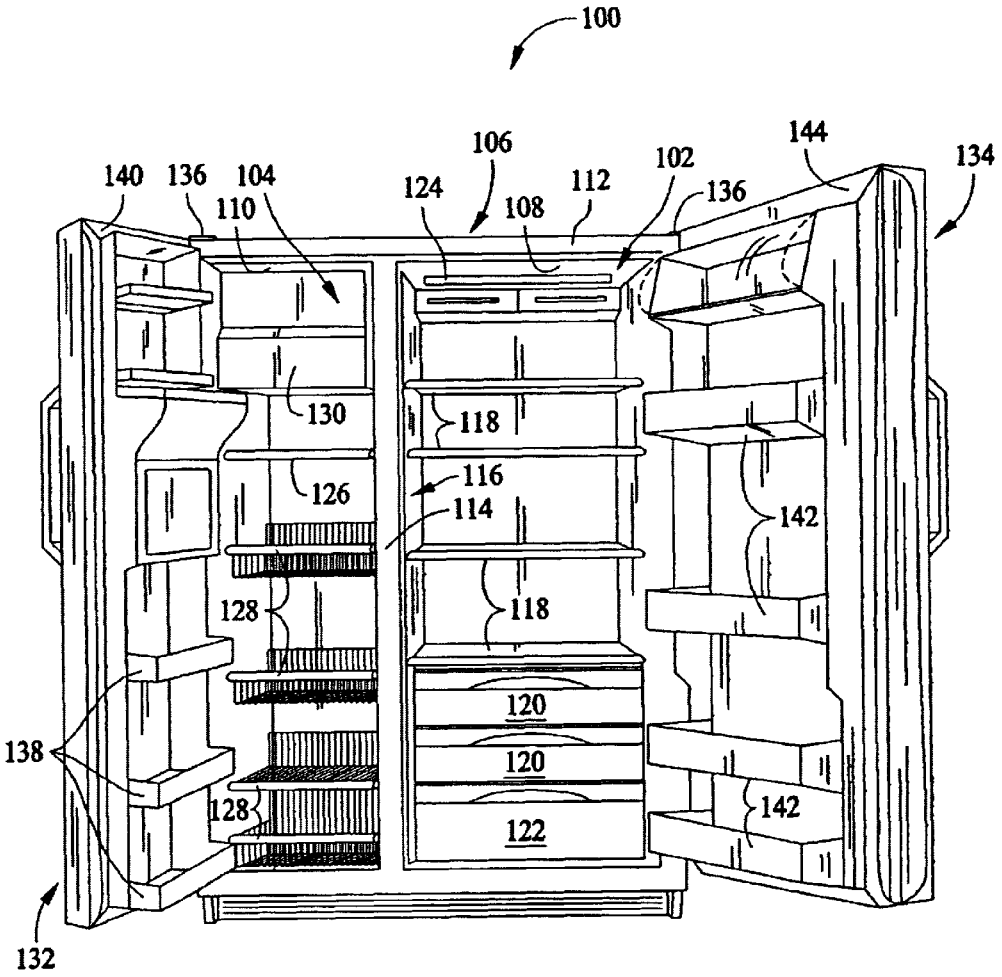
FIG. 1 illustrates a side-by-side refrigerator.

FIG. 1 illustrates an exemplary refrigerator 100. While the apparatus is described herein in the context of a specific refrigerator 100, it is contemplated that the herein described methods and apparatus may be practiced in other types of refrigerators. Therefore, as the benefits of the herein described methods and apparatus accrue generally to ice maker controls in a variety of refrigeration appliances and machines, the description herein is for exemplary purposes only and is not intended to limit practice of the invention to a particular refrigeration appliance or machine, such as refrigerator 100.

Figure 2:
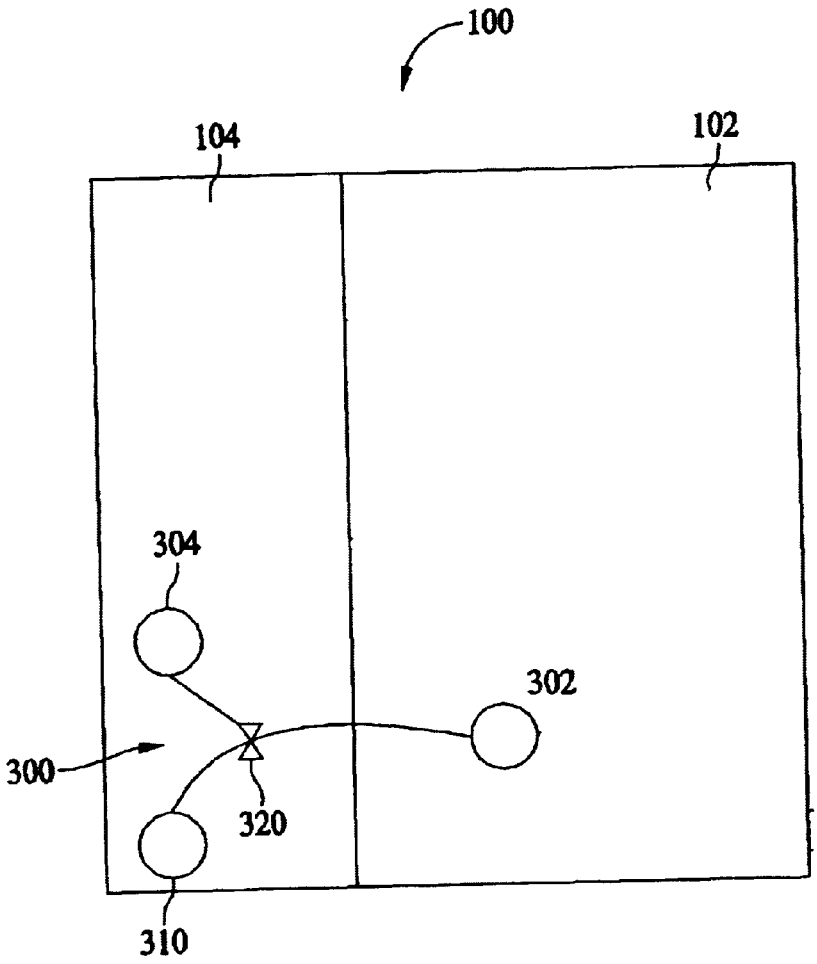
FIG. 2 is a schematic view of the refrigerator of FIG. 1.

Refrigerator 100 is includes a fresh food storage compartment 102 and freezer storage compartment 104. Freezer compartment 104 and fresh food compartment 102 are arranged side-by-side, however, the benefits of the herein described methods and apparatus accrue to other configurations such as, for example, top and bottom mount refrigerator-freezers. Refrigerator 100 includes a sealed system 300 including separate evaporators 302 and 304 respectively, for fresh food compartment 102 and freezer compartment 104 as shown schematically in FIG. 2. Sealed system 300 includes a single compressor 310 connected to both evaporators 302 and 304 using a three-way valve 320. A temperature in fresh food compartment 102 is independently controlled using evaporator 302. Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as prepainted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also, in one embodiment, is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 is positioned within compartment 102. A control interface 124 is mounted in an upper region of fresh food storage compartment 102 and coupled to a microprocessor. Interface 124 is configured to accept an input regarding speed ice mode and normal ice mode. Interface 124 is also configured, in one embodiment, to display the mode. A shelf 126 and wire baskets 128 are also provided in freezer compartment 104. In addition, an ice maker 130 is provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 3:
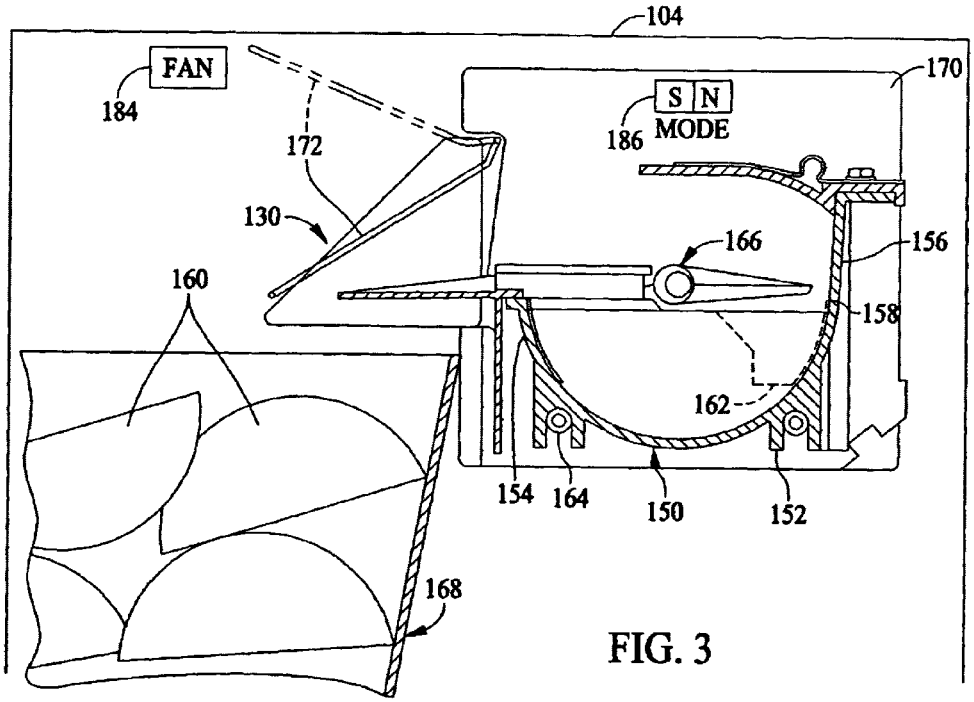
FIG. 3 is a cross sectional view of an exemplary ice maker in a freezer compartment.

FIG. 3 is a cross sectional view of ice maker 130 including a metal mold 150 with a tray structure having a bottom wall 152, a front wall 154, and a back wall 156. A plurality of partition walls 158 extend transversely across mold 150 to define cavities in which ice pieces 160 are formed. Each partition wall 158 includes a recessed upper edge portion 162 through which water flows successively through each cavity to fill mold 150 with water.

A sheathed electrical resistance ice removal heating element 164 is press-fit, staked, and/or clamped into bottom wall 152 of mold 150 and heats mold 150 when a harvest cycle is executed to slightly melt ice pieces 160 and release them from the mold cavities. A rotating rake 166 sweeps through mold 150 as ice is harvested and ejects ice from mold 150 into a storage bin 168 or ice bucket. Cyclical operation of heater 164 and rake 166 are effected by a controller 170 disposed on a forward end of mold 150, and controller 170 also automatically provides for refilling mold 150 with water for ice formation after ice is harvested through actuation of a water valve (not shown in FIG. 3) connected to a water source (not shown) and delivering water to mold 150 through an inlet structure (not shown).

In order to sense a level of ice pieces 160 in storage bin, 168 controller actuates a spring loaded feeler arm 172 for controlling an automatic ice harvest so as to maintain a selected level of ice in storage bin 168. Feeler arm 172 is automatically raised and lowered during operation of ice maker 130 as ice is formed. Feeler arm 172 is spring biased to a lowered home position that is used to determine initiation of a harvest cycle and raised by a mechanism (not shown) as ice is harvested to clear ice entry into storage bin 138 and to prevent accumulation of ice above feeler arm 172 so that feeler arm 172 does not move ice out of storage bin 168 as feeler arm 172 raises. When ice obstructs feeler arm 172 from reaching its home position, controller 170 discontinues harvesting because storage bin 168 is sufficiently full. As ice is removed from storage bin 168, feeler arm 172 gradually moves to its home position, thereby indicating a need for more ice and causing controller 170 to initiate formation and harvesting of ice pieces 160, as is further explained below. Ice maker 130 also includes a fan 184 and a mode switch 186 whereby speed mode or normal mode is selected. Operation of fan 184 is controlled by interface 124 based on the selected mode.

In another exemplary embodiment, a cam-driven feeler arm (not shown) rotates underneath ice maker 130 and out over storage bin 168 as ice is formed. Feeler arm 172 is spring biased to an outward or home position that is used to initiate an ice harvest cycle, and is rotated inward and underneath ice maker 130 by a cam slide mechanism (not shown) as ice is harvested from ice maker mold 150 so that the feeler arm does not obstruct ice from entering storage bin 168 and to prevent accumulation of ice above the feeler arm. After ice is harvested, the feeler arm is rotated outward from underneath ice maker 130, and when ice obstructs the feeler arm and prevents the feeler arm from reaching the home position, controller 170 discontinues harvesting because storage bin 168 is sufficiently full. As ice is removed from storage bin 168, feeler arm 172 gradually moves to its home position, thereby indicating a need for more ice and causing controller 170 to initiate formation and harvesting of ice pieces 160, as is further explained below.

While the following control scheme is described in the context of a specific ice maker 130, the control schemes set forth below are easily adaptable to differently configured ice makers, and the herein described methods and apparatus is not limited to practice with a specific ice maker, such as, for example, ice maker 130. Moreover, while the following control scheme is described with reference to specific time and temperature control parameters for operating one embodiment of an ice maker, other control parameters, including but not limited to time and temperature values, may be used within the scope of the present invention. The control scheme herein described is therefore intended for purposes of illustration rather than limitation.

Figure 4:
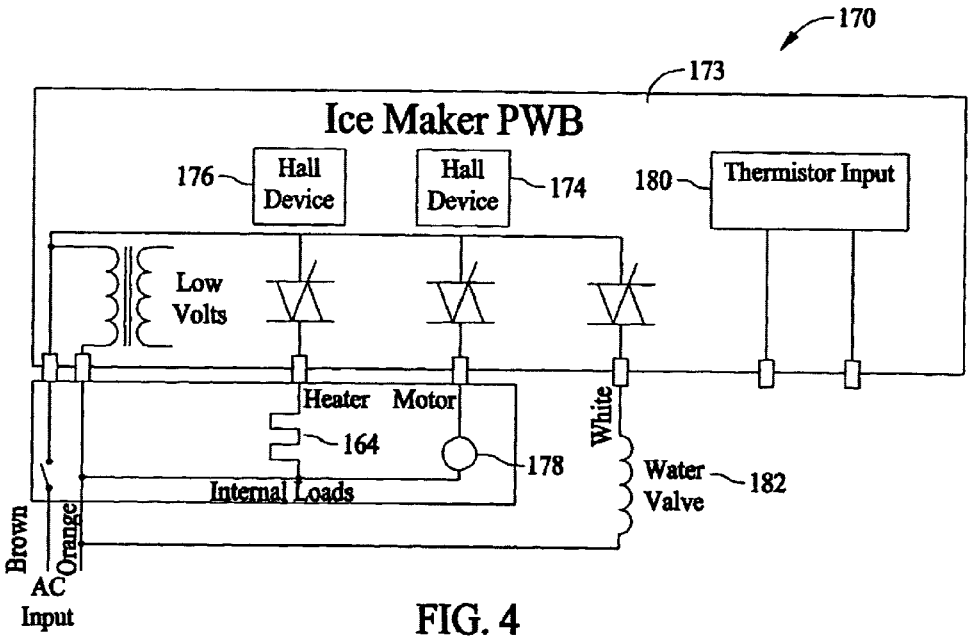
FIG. 4 is a block diagram of an exemplary ice maker controller.

FIG. 4 is a block diagram of an exemplary ice maker controller 170 including a printed wiring board (PWB) or controller board 173 coupled to a first hall effect sensor 174, a second hall effect sensor 176, heater 164, a motor 178 for rotating rake 166 and feeler arm 172 (shown in FIG. 3), at least one thermistor 180 in flow communication with but insulated from ice maker mold 150 (shown in FIG. 3) to determine an operating temperature, of ice, water or air therein, and an electromechanical water valve 182 for filling and re-filling ice maker mold 150 after ice is harvested and removed from mold 150. Hall effect sensors 174, 176 and thermistor 180 are known transducers for detecting a position and a temperature, respectively, and producing corresponding electrical signal inputs to controller board 173. First hall effect sensor 174 is used in accordance with known techniques to monitor a position of a motor shaft (not shown) which drives rake 166, and second hall effect sensor 176 is used in accordance with known techniques to monitor a position of feeler arm 172 (shown in FIG. 3). Specifically, hall effect sensors 174, 176 detect a position of magnets (not shown) coupled to rake 166 and feeler arm 172 in relation to a designated home position. In response to input signals from first and second hall effect sensors 174,176 and thermistor 180, controller board 173 employs control logic and a known 8 bit processor to control ice maker components according to the control schemes described below.

In an alternative embodiment, other known transducers are utilized in lieu of hall effect sensors 174, 176 to detect operating positions of the motor shaft and feeler arm 172 for use in feedback control of ice maker 130 (shown in FIGS. 1 and 3). A sensing device senses the ice maker mode and communicates that to the refrigerator control. Other sensors can be used to monitor the state or status of the ice making process which is communicated to the refrigerator control. This can be implemented by taking a known ice maker and sensing the current flow to the valve to determine a fill operation, or sensing the temperature of the mold body to detect heat activity, or by putting a communication link between ice maker 130 and a refrigerator controller (not shown). Additionally, other operations of ice maker 130 may be monitored for activity. Also, besides monitoring ice maker directly, indirect methods of detecting activity could be employed such as monitoring the water pressure to the water line feeding ice maker 130. Once the status of ice maker 130 is known to the refrigerator control system, the refrigerator controller controls sealed system 300 to increase ice rate as herein described. For example, when the main controller detects an ice maker water fill, it changes a control setting in freezer compartment 104 to lower the temperature, run evaporator fan 184 at a different speed, and run evaporator fan 184 at off cycle to improve heat exchange between freezer compartment 104 and ice maker 130 to produce ice faster. Running fan 184 at off cycle is for a fixed time window depending on freezer compartment temperature or with sensor feedback from ice maker 130. It should be understood that the rate of ice production is increased simply by running fan. 184 continuously without sensing the status or state of ice maker 130; however this results in a negative energy impact on sealed system 300. Therefore, in one embodiment, upon receiving an indication of activity of ice maker 130, the controller directs sealed system 300 to lower the temperature in freezer compartment 104 for a predetermined period of time such as 1 hour and one-half hour. The controller returns to normal operation after the predetermined time period. For example, the controller is set to maintain the temperature of freezer compartment 104 at 0 degrees Fahrenheit, and upon receiving an indication of activity of ice maker 130, the controller lower the temperature to −6 degrees F for one-half hour. In one embodiment, the indication of activity is of an opening of water valve 182 during a fill operation. In another embodiment, the indication is of a closing of water valve 182 indicating an end to a fill cycle (i.e., that the valve was in an open state).

Figure 5:
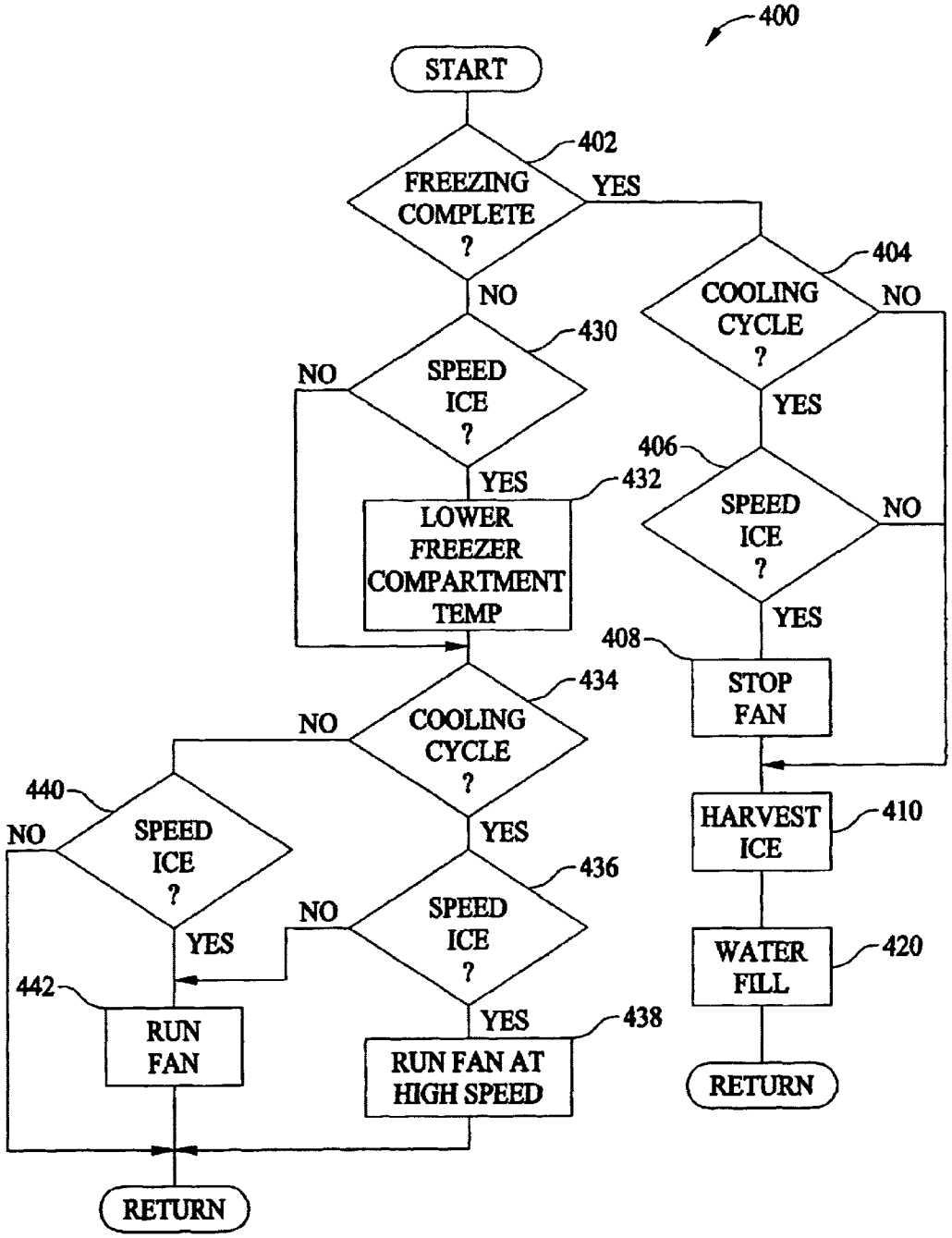
FIG. 5 is a flow chart of an exemplary smart sensing algorithm for making ice.

FIG. 5 is a flow chart of an exemplary smart sensing algorithm 400 executed by controller 170. In operation, sensors 174,176 of ice maker controller 170 monitor the ice making process and transmit data to controller 170. Ice maker controller 170 interprets the transmitted sensor data and communicates the status of ice maker 1.30 to the refrigerator control system. In one embodiment, instead of always operating in the herein described speed mode, refrigerator 100 includes a normal mode corresponding to normal ice production. In one embodiment, a user indicates or selects normal mode or speed mode through mode switch 186. In another embodiment, speed mode is automatically entered when a sensor senses a low ice condition. In another embodiment, speed mode is the only ice making mode implemented in refrigerator 100. Ice making mode, either normal or speed mode is monitored throughout the ice making process.

Algorithm 400 begins at step 402 with a status check to determine if freezing of ice is completed. If so, processing continues at 404 where a check is made to determine if a cooling cycle is in progress. If a cooling cycle is not indicated, ice is harvested at 410 followed by a water fill at step 420, followed by a return to start. If a cooling cycle is indicated at 404, the algorithm checks at 406 to determine whether ice maker 130 is in speed ice mode.:If in speed ice mode, fan 184 is stopped at step 408. This reduces heat dissipation from ice maker 130 to freezer compartment 104 and reduces the heat required to release the ice from ice maker 130. Ice is then harvested at 410 followed by water fill at 420.

If at step 402, it is determined that freezing is not complete, the algorithm continues at step 430 to check the ice maker mode. If ice maker 130 is in speed ice mode, the refrigerator controller is signaled to lower the freezer compartment temperature at step 432 to accelerate the freezing process. Algorithm 400 then continues at step 434 where a check is made to determine if a cooling cycle is in progress. If a cooling cycle is not indicated at 434, the algorithm continues at step 440 to determine whether ice maker 130 is in speed ice mode. If in speed ice mode, fan 184 is energized at step 442 to accelerate the freezing process. If not in speed ice mode, fan 184 is not energized and processing returns to the start of the algorithm. If at step 434, it is determined that a cooling cycle is in progress, a check is made at 436 to determine whether ice maker 130 is in speed ice mode. If not, fan 184 is run at its normal speed at step 442. If ice maker 130 is determined to be in speed ice mode at step 436, fan 184 is operated at high speed at step 438 to accelerate the freezing process. Processing returns to the start of the algorithm after steps 442 and 438.

In empirical testing of refrigerator 100, three pounds of ice per day was provided when operated in normal mode and five pounds of ice per day was provided in speed ice mode.

While the invention has been described in terms of various specific embodiments, those skilled in the art will recognize that the invention can be practiced with modification within the spirit and scope of the claims.

What is claimed is:

1. A refrigerator comprising:

a fresh food compartment;

a refrigerator evaporator operationally coupled to said fresh food compartment and configured to cool said fresh food compartment;

a refrigerator evaporator fan positioned to move air across said refrigerator evaporator;

a freezer compartment separated from said fresh food compartment by a mullion;

a freezer evaporator operationally coupled to said freezer compartment and configured to cool said freezer compartment;

a freezer evaporator fan positioned to move air across said freezer evaporator;

an ice maker positioned within said freezer compartment; and a refrigerator control system configured to control at least one of said freezer evaporator and said freezer evaporator fan, said refrigerator control system configured to receive a signal regarding said ice maker.

2. A refrigerator in accordance with claim 1 wherein said refrigerator control system further configured to control at least one of said freezer evaporator and said freezer evaporator fan based upon the received ice maker signal.

3. A refrigerator in accordance with claim 2 wherein said refrigerator control system further configured to control both of said freezer evaporator and said freezer evaporator fan based upon the received ice maker signal.

4. A refrigerator in accordance with claim 1 wherein said ice maker comprises:

a mold comprising at least one cavity for containing water therein for freezing into ice;

a water supply comprising at least one valve for controlling water flow into said mold;

an ice removal heating element operationally coupled to said mold; and an ice maker control system configured to:

control said valve;

control said ice removal heating element; and provide a signal to the refrigerator control system regarding at least one of said valve and said ice removal heating element.

5. A refrigerator in accordance with claim 4 wherein said ice maker control system further configured to transmit to the refrigerator control system a signal that said valve is in an open state letting water flow into said at least one mold cavity.

6. A refrigerator in accordance with claim 4 wherein said ice maker control system further configured to transmit to the refrigerator control system a signal that said valve was in an open state letting water flow into said at least one mold cavity.

7. A refrigerator in accordance with claim 4 wherein said ice maker control system further configured to transmit to the refrigerator control system a signal that said ice removal heating element is energized.

8. A refrigerator in accordance with claim 4 wherein said refrigerator control system configured to receive a signal representative of a user selected ice maker speed.

9. A refrigerator in accordance with claim 1 wherein said refrigerator control system configured to receive a signal representative of a user selected ice maker speed.

10. A refrigerator in accordance with claim 9 wherein said refrigerator control system further configured to control at least one of said freezer evaporator and said freezer evaporator fan based upon the received ice maker signal when the received signal comprises a speed ice mode indication, and not to control at least one of said freezer evaporator and said freezer evaporator fan based upon the received ice maker signal when the received signal comprises a normal ice mode indication.

11. A refrigerator in accordance with claim 9 wherein said refrigerator control system configured to control said freezer evaporator fan based on the received signal representative of a user selected ice mode including a speed ice mode and a normal ice mode such that:

when the received signal is representative of speed ice mode:

said freezer evaporator fan is energized during cooling cycles, and said freezer evaporator fan is energized selectively during non-cooling cycles in conjunction with predetermined ice make modes; and when the received signal is representative of normal ice mode:

said freezer evaporator fan is energized during cooling cycles, and said freezer evaporator fan is de-energized during non cooling cycles.

12. A refrigerator in accordance with claim 11 wherein said ice maker comprises:

a mold comprising at least one cavity for containing water therein for freezing into ice;

a water supply comprising at least one valve for controlling water flow into said mold;

an ice removal heating element operationally coupled to said mold; and an ice maker control system configured to:

control said valve;

control said ice removal heating element; and provide a signal to the refrigerator control system regarding at least one of said valve and said ice removal heating element.

* * * * *

UNITED STATES PATENT AND TRADEMARK OFFICE

CERTIFICATE OF CORRECTION

PATENT NO. : 6,679,073 B1
DATED : January 20, 2004
INVENTOR(S) : Ziqiang Hu

It is certified that error appears in the above-identified patent and that said Letters Patent is hereby corrected as shown below:

Column 1,
Line 12, delete “(if” and insert therefor -- of --.
Line 23, delete “an d” and insert therefor -- and --.

Column 5,
Line 34, delete “fan. 184” and insert therefor -- fan 184 --.
Line 56, delete “1.30” and insert therefor -- 130 --.

Column 6,
Line 8, delete “mode.:If” and insert therefor -- mode. If --.

Signed and Sealed this

Twenty-seventh Day of September, 2005

JON W. DUDAS
*Director of the United States Patent and Trademark Office*